US008235552B1

(12) United States Patent
Tsuge

(10) Patent No.: US 8,235,552 B1
(45) Date of Patent: Aug. 7, 2012

(54) CORDLESS FLASHLIGHT AND RADIO DEVICE

(75) Inventor: Kazunori Tsuge, Anjo (JP)

(73) Assignee: Makita Corporation, Anjo-Shi (JP)

( * ) Notice: Subject to any disclaimer, the term of this patent is extended or adjusted under 35 U.S.C. 154(b) by 58 days.

(21) Appl. No.: 13/035,351

(22) Filed: Feb. 25, 2011

(51) Int. Cl.
*F21V 33/00* (2006.01)
*F21V 17/02* (2006.01)

(52) U.S. Cl. ..... 362/253; 362/319

(58) Field of Classification Search ..... 362/194, 362/195, 190, 191, 253, 319; 455/90.1, 90.3
See application file for complete search history.

(56) References Cited

U.S. PATENT DOCUMENTS

| | | | | |
|---|---|---|---|---|
| 4,045,663 | A * | 8/1977 | Young | 362/253 |
| D302,013 | S * | 7/1989 | Yuen | D14/168 |
| 5,055,986 | A | 10/1991 | Johnson | |
| D378,818 | S * | 4/1997 | Yuen | D14/168 |
| 5,731,759 | A | 3/1998 | Finucan | |
| 6,238,061 | B1 | 5/2001 | McKenzie et al. | |
| 6,286,973 | B1 | 9/2001 | Thrower | |
| 6,296,370 | B1 * | 10/2001 | Bamber et al. | 362/190 |
| 6,315,425 | B1 * | 11/2001 | Confrey | 362/253 |
| 6,536,917 | B1 | 3/2003 | Aperocho et al. | |
| D489,703 | S * | 5/2004 | Tien | D14/168 |
| 7,006,002 | B2 | 2/2006 | Shomali | |
| 7,043,283 | B2 | 5/2006 | Domes | |
| 7,188,969 | B2 * | 3/2007 | Uke et al. | 362/208 |
| 7,303,298 | B2 * | 12/2007 | Bhavnani | 362/86 |
| 2002/0079867 | A1 | 6/2002 | Sakakibara et al. | |
| 2005/0112416 | A1 | 5/2005 | Sakakibara | |
| 2005/0225288 | A1 | 10/2005 | Cole et al. | |
| 2006/0119104 | A1 | 6/2006 | Wall | |
| 2006/0262947 | A1 | 11/2006 | Liang | |
| 2007/0002562 | A1 | 1/2007 | VanWambeke et al. | |
| 2010/0063757 | A1 | 3/2010 | Suzuki | |
| 2010/0084150 | A1 | 4/2010 | Suzuki et al. | |
| 2010/0085008 | A1 | 4/2010 | Suzuki et al. | |
| 2010/0085010 | A1 | 4/2010 | Suzuki et al. | |
| 2010/0085020 | A1 | 4/2010 | Suzuki et al. | |
| 2010/0129701 | A1 | 5/2010 | Murayama et al. | |
| 2010/0156350 | A1 | 6/2010 | Murayama et al. | |

OTHER PUBLICATIONS

Print-out from http://www.hitachi-koki.com/powertools/products/li_ion/ur10dl/ur10dl.html for Cordless Radio, model No. UR1ODL, sold by Hitachi Koki Co., Ltd.
Instruction Manual for Cordless Radio, model No. UR1ODL, sold by Hitachi Koki Co., Ltd.
Instruction manual for flashlight, model No. BML240, sold by Makita Corporation—see in particular, pp. 1, 2, 9 and 10.
Instruction manual for radio, model No. BMR100, sold by Makita Corporation.

* cited by examiner

*Primary Examiner* — Sonny Trinh
(74) *Attorney, Agent, or Firm* — J-Tek Law PLLC; Jeffrey D. Tekanic

(57) ABSTRACT

A portable battery-powered device comprises a lamp unit pivotably attached to a front side of a housing. A radio unit is disposed within the housing. At least one speaker is electrically coupled to the radio unit and is disposed on the front side of the housing such that the lamp unit and the speaker face the same direction. A battery pack holder is disposed on a bottom side of the housing and is configured to retain a rechargeable battery pack.

20 Claims, 8 Drawing Sheets

CORDLESS FLASHLIGHT AND RADIO DEVICE

TECHNICAL FIELD

The present invention generally relates to a portable, battery-operated flashlight/radio combination device.

RELATED ART

US Patent Publication no. 2007-0002562 A1 discloses an emergency device that includes a light and a radio, which are capable of switching between conventional AC power and DC battery power in the event of a power failure. The light is fixedly attached to a top housing portion of the device and a speaker for the radio is disposed at a bottom housing portion of the device. A rechargeable flashlight is removably attached to a lateral side of the housing. A rechargeable storage battery is permanently disposed within the housing of the device.

Hitachi Koki Co. Ltd. of Tokyo Japan has previously sold a cordless radio, model number UR10DL, which includes a LED light disposed on a front side of the housing body and a radio speaker disposed on a lateral side of the housing body. Thus, the light shines in a direction that is different from the direction in which the sound is projected. The cordless radio and light are powered by a detachable and rechargeable lithium ion battery.

Makita Corporation of Anjo Japan, the Assignee of the present invention, has previously sold a cordless flashlight, model number BML240, which includes a lamp unit pivotably attached to a front side of the housing and a rechargeable battery pack detachably coupled to a bottom side of the housing.

SUMMARY

It is an object of the present teachings to disclose an improved flashlight/radio device.

In one aspect of the present teachings, a portable battery-powered device preferably comprises a lamp unit pivotably attached or coupled to a front side of a housing. A radio unit is preferably disposed within the housing. At least one speaker may be electrically coupled to the radio unit and disposed on the front side of the housing such that the lamp unit and the speaker face the same direction. A battery pack holder is disposed or defined on a bottom or lower side of the housing and is configured to detachably retain a rechargeable battery pack.

Such an embodiment of the present teachings provides the advantage, e.g., that the speaker directs sound in the same or substantially the same direction as the illumination direction of the pivotable lamp unit. Thus, as compared to the above-described known flashlight/radio device, in which the lamp unit and speaker face different directions, a person working in an area illuminated by the lamp unit will experience improved sound clarity and fidelity and/or a lower volume setting can be used, thereby reducing power consumption by the radio unit.

In addition, the portable battery-powered device may optionally further comprise a rechargeable battery pack mounted on and electrically coupled to the battery pack holder. Optionally, the rechargeable battery pack may be configured to slidably engage the battery pack holder. In addition or in the alternative, the battery pack may output a voltage between 10-36 volts, more preferably between 10-24 volts, even more preferably between about 14-18 volts, and/or the device may be configured to operate based upon any voltage supplied by the attached battery pack.

In addition or in the alternative, the lamp unit may have substantially the same width as a widest portion of the front side of the housing.

In addition or in the alternative, the speaker may be disposed directly between the lamp unit and the battery pack holder.

In addition or in the alternative, a protective grill may preferably cover the speaker. Optionally, a widest portion of the protective grill may have substantially the same width as the lamp unit.

In addition or in the alternative, the speaker may have substantially the same width as the lamp unit.

In addition or in the alternative, the lamp unit may be configured to cover and protect at least a portion of the protective grill when the lamp unit is pivoted towards the bottom side of the housing.

In addition or in the alternative, a handle may be coupled or attached to (or integrated with) a top or upper side of the housing. Optionally, a hollow space may be defined between the handle and the housing and configured to receive the fingers of the person carrying the device.

In addition or in the alternative, a switch may be disposed on the top or upper side of the handle and configured to actuate the lamp unit.

In addition or in the alternative, a display and/or one or more switches configured to control the radio unit may be disposed on a lateral side of the housing.

In addition or in the alternative, the lamp unit may have an illumination output between 500 to 5,000 lux, more preferably between 1,000 to 3,000 lux and even more preferably between about 1,200 to 2,000 lux.

In addition or in the alternative, the front side of the housing may have a width between 6-12 centimeters, more preferably between 7-10 centimeters.

Further objects, embodiments, features and advantages of the present teachings will be apparent to the person of ordinary skill in the art upon reading the following detailed description in view of the appended drawings and claims.

DETAILED DESCRIPTION OF THE INVENTION

Figure 1:
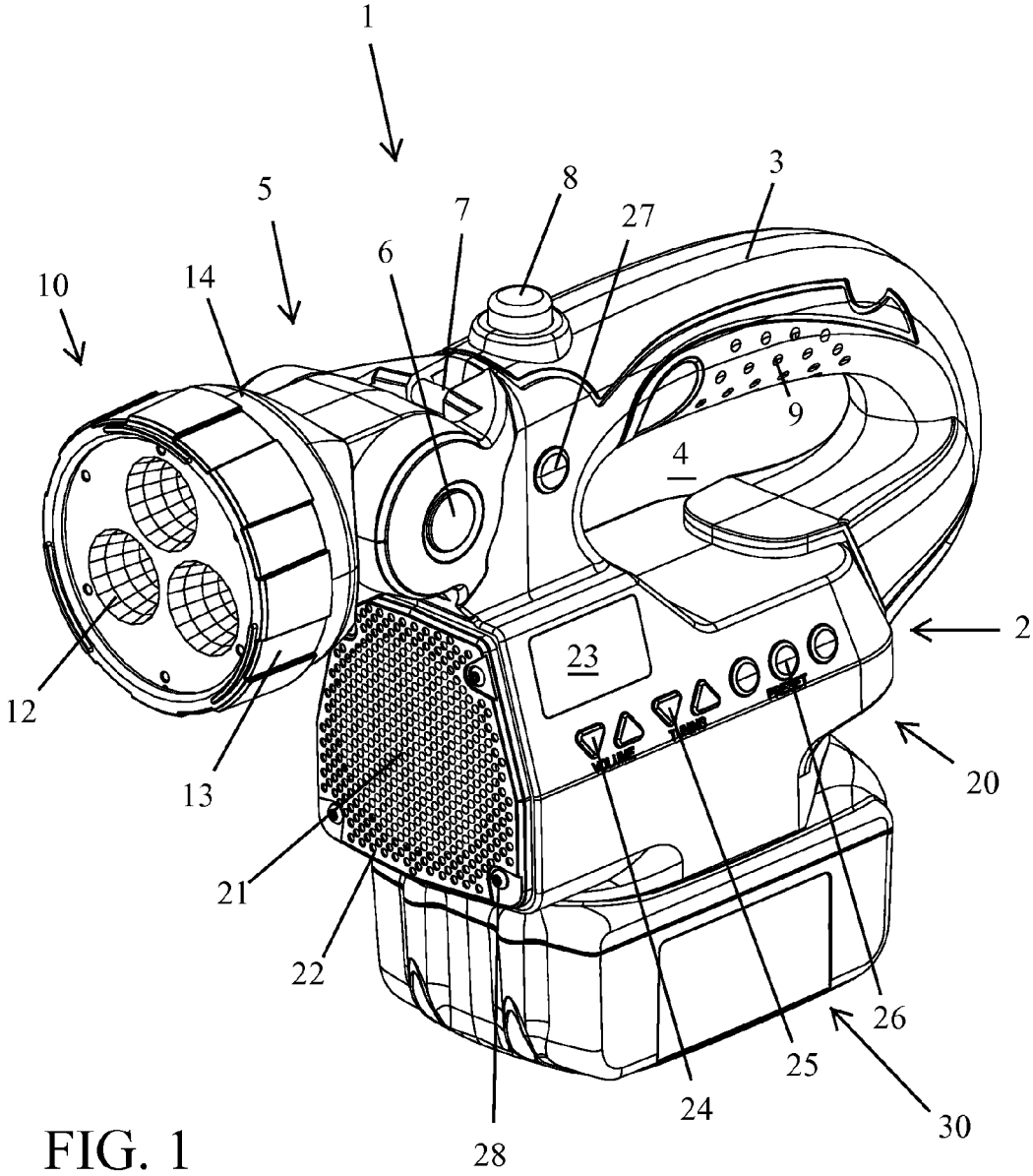
FIG. 1 shows a front perspective view of a portable flashlight/radio device according to a representative embodiment of the present teachings.

Referring now to FIG. 1, a combination flashlight and radio device 1 according to the present teachings generally comprises a housing 2 and a detachable rechargeable battery pack 30.

The housing 2 preferably includes a handle 3 for convenient carrying. The handle 3 is preferably contiguous with (or at least coupled to) the housing 2 and a hollow space 4 is preferably defined between the handle 3 and the housing 2 for inserting or receiving the operator's fingers when carrying the device 1. The handle 3 is preferably disposed on or extends from a top or upper surface of the housing 2. A soft grip portion 9 is preferably provided on the lower portion of the handle 3 in order to improve the operator's feel and comfort when carrying the device 1.

A lamp unit 10 is pivotably attached or coupled to a forward or front end of the handle 3 and/or housing 2 via a hinge 5. In the present embodiment, the lamp unit 10 is pivotable upwardly and downwardly about the hinge 5 (i.e. about a substantially horizontal axis), as shown for example in FIGS. 3 and 4. However, other types of hinges may be utilized that permit, e.g., horizontal pivoting about a vertical axis (i.e. side-to-side or lateral pivoting) or pivoting in all directions about a point (i.e. pivoting within an imaginary conical projection extending from the hinge point).

Although not shown in the drawings, the hinge 5 comprise, e.g., a pair of pivot terminal units that are coupled to respective lateral sides of the lamp unit 10 (or lamp case 14 as discussed further below), e.g., via a pair of body covers. A compression spring is disposed between each pivot terminal and inner surface of an abutment portion 6 that is pivotable relative to the housing 2.

A switch 8, preferably a push-button switch with a rubber cover, is disposed at a top, forward end of the handle 3 and is electrically configured to actuate the lamp unit 10, i.e. turn it ON and OFF. The switch 8 is preferably located to permit the lamp unit 10 to be actuated using the thumb of the same hand that is carrying the device 1 by the handle 3.

Figure 4:
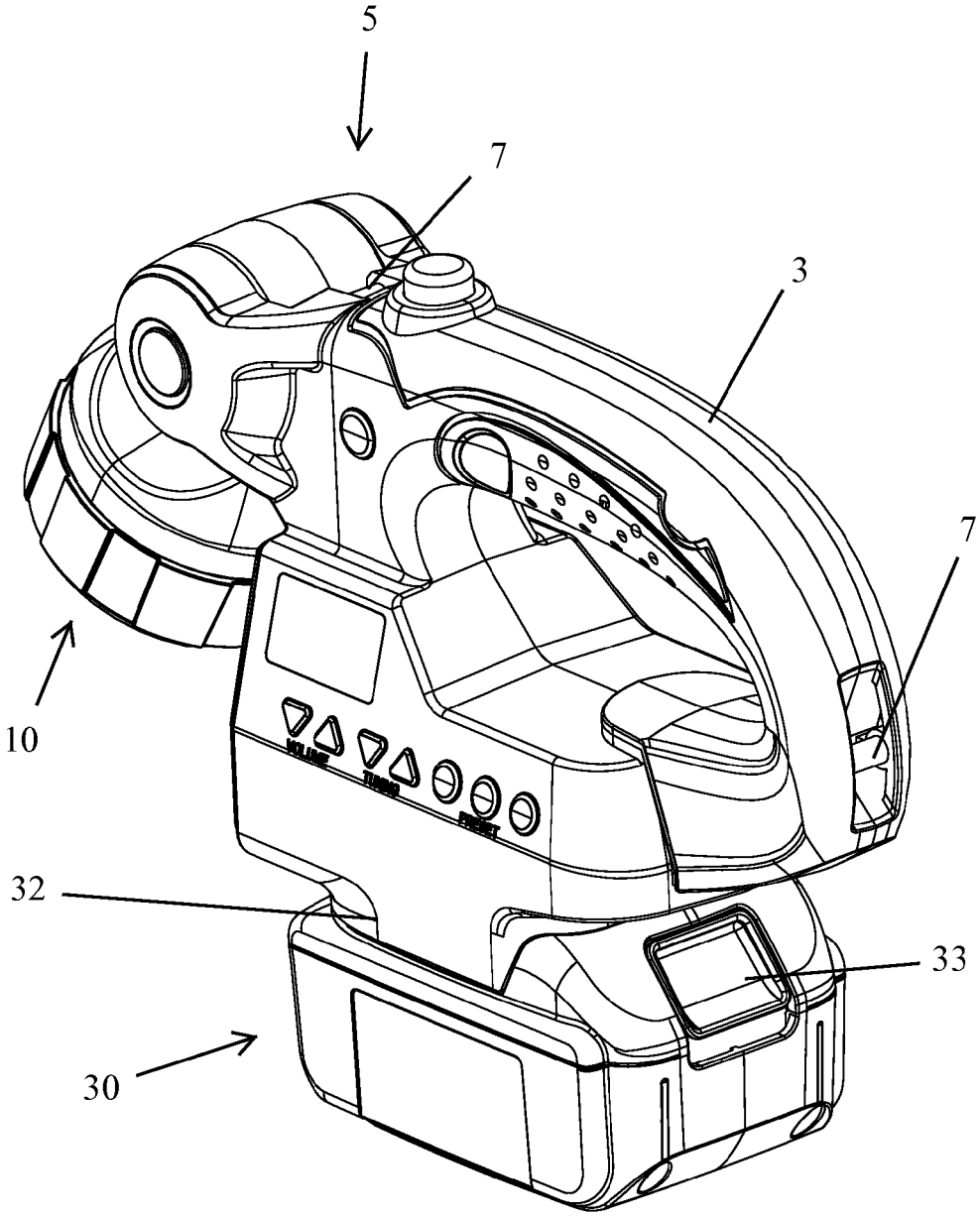
FIG. 4 shows the device according to FIGS. 1-3 in a rear perspective view.

As shown in FIGS. 1 and 4, a pair of strap holders 7 may be provided and configured to retain respective ends of a carrying strap (not shown).

Figure 2:
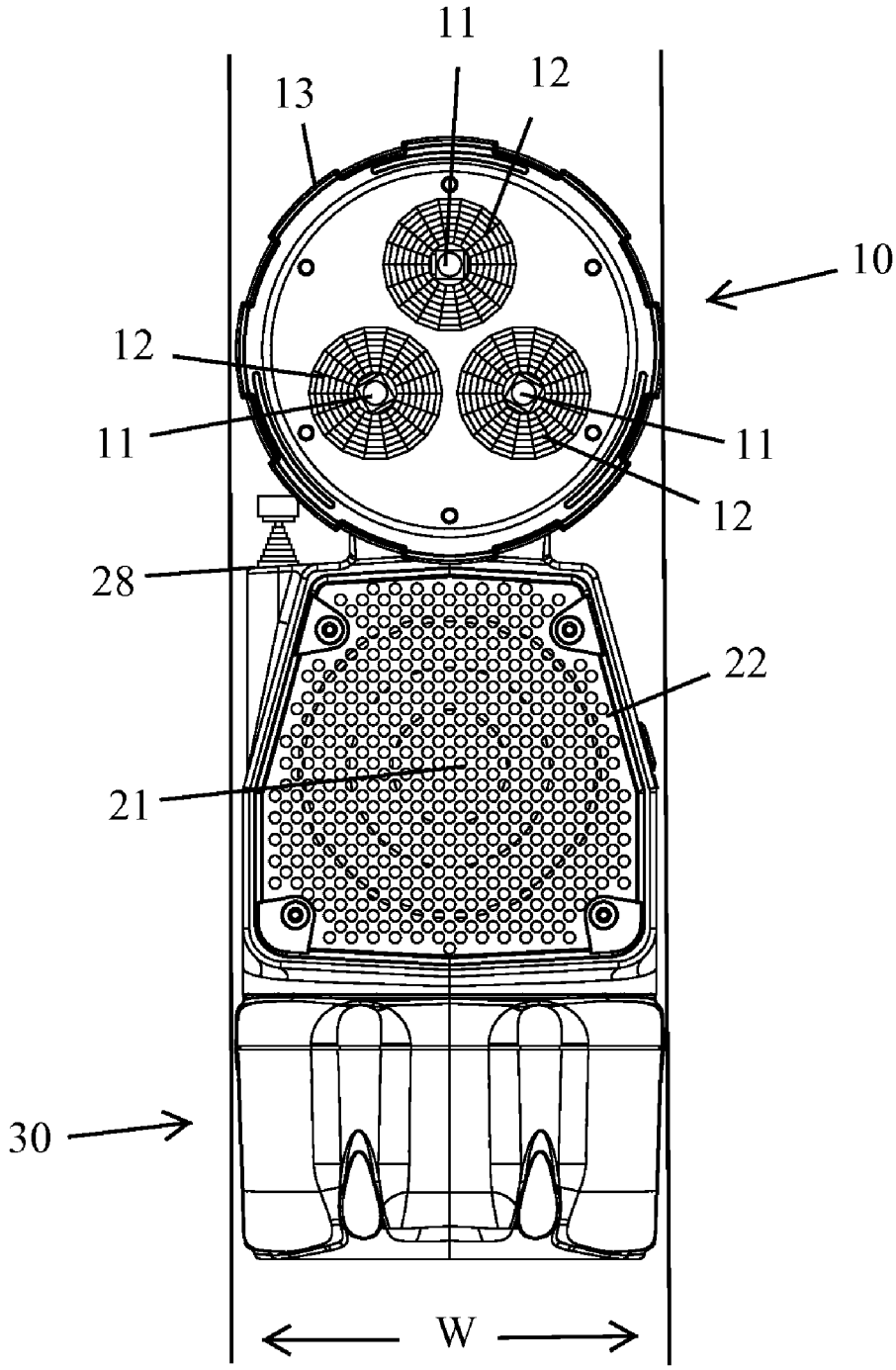
FIG. 2 shows the front side of the device according to FIG. 1.

Referring to FIG. 2, the lamp unit 10 may comprise three lamps or bulbs 11, although greater or less than three may be utilized depending upon the particular application of the present teachings. Each lamp 11 is preferably surrounded by a reflector 12 in order to focus or concentrate the illumination in the forward direction of the lamp unit 10. Although not shown, a lens may cover the lamp(s) 11 to protect the lamp(s) 11 from the outside environment during normal operation. A reflector retainer 13 may be threadably engaged with a lamp case 14 in order to hold the lens and reflector(s) 12 on the lamp case 14 and permit easy access to the lamps 11 for easy replacement in case one or more lamps 11 burns out. The lamp case 14 is pivotably coupled to the housing 2 via the hinge 5, as was discussed above.

The lamp(s) 11 may be, e.g., one or more xenon bulbs, light-emitting diodes (LEDs), high intensity discharge (HID) lamps, fluorescent lamps and/or incandescent lamps.

The lamp unit 10 preferably provides in illumination output of between about 500 to 5000 lux, more preferably between 1000 to 3000 lux, even more preferably between 1200 to 2000 lux, and most preferably about 1400 lux.

Referring back to FIG. 1, a radio unit 20 is comprised within the housing 2 and generally includes a speaker 21 having a protective grill 22 mounted to the housing 2 via one or more screws 28. A display 23 is preferably provided on a lateral surface of the housing 2 and may be configured to display status information, such as one or more of radio station frequencies, i.e. to which the radio unit 20 is tuned, band indicator, volume, time (i.e. a clock optionally including AM and/or PM indications), alarm, battery level, reception strength, etc. The display 23 is preferably a liquid crystal display or digital backlit quartz display, although other display technologies, such as LEDs, etc. also may be advantageously utilized.

The radio unit 20 preferably includes one or more volume controls, such as up and down volume buttons 24. However, other devices for controlling the volume, such as a rotatable dial may be utilized. One or more tuning buttons 25 are preferably configured to set the radio station frequency, but again, a rotatable dial or other type of input device may be utilized. Further, one or more preset station buttons 26 may be provided (e.g., three in the present example) so that the operator can store one or more preferred radio station frequencies in a memory within the device 1. A power button 27 for the radio unit 20 also may be provided on the housing 2, preferably at a location where the operator can easily press the power button 27 with the thumb of the same hand that is holding the handle 3. However, if a rotatable dial is provided for the volume control, the power function may be integrated into the volume control.

An adjustable sleep timer (auto shut off) may optionally be provided, as well as e.g., an alarm (e.g. wake up) feature and an (adjustable) snooze button. In addition or in the alternative, a scan tuning button and/or time set button may be provided. It is understood that appropriate circuitry will be provided in the housing 2 to implement any additional functions that are provided, with a representative example provided in FIG. 8, as will be further discussed below.

Because the operation of a radio is well known in the art, it is not necessary to describe the internal circuitry in detail. It is sufficient to note that an extendable/retractable antenna 28 (see FIG. 2) is preferably provided to receive radio wave signals that are then processed and amplified into signals for driving the speaker 21 utilizing well known technology. The radio unit 20 is preferably configured to receive and process signals in the AM and FM frequency bands, as well as optionally also the weather frequency band.

Figure 5:
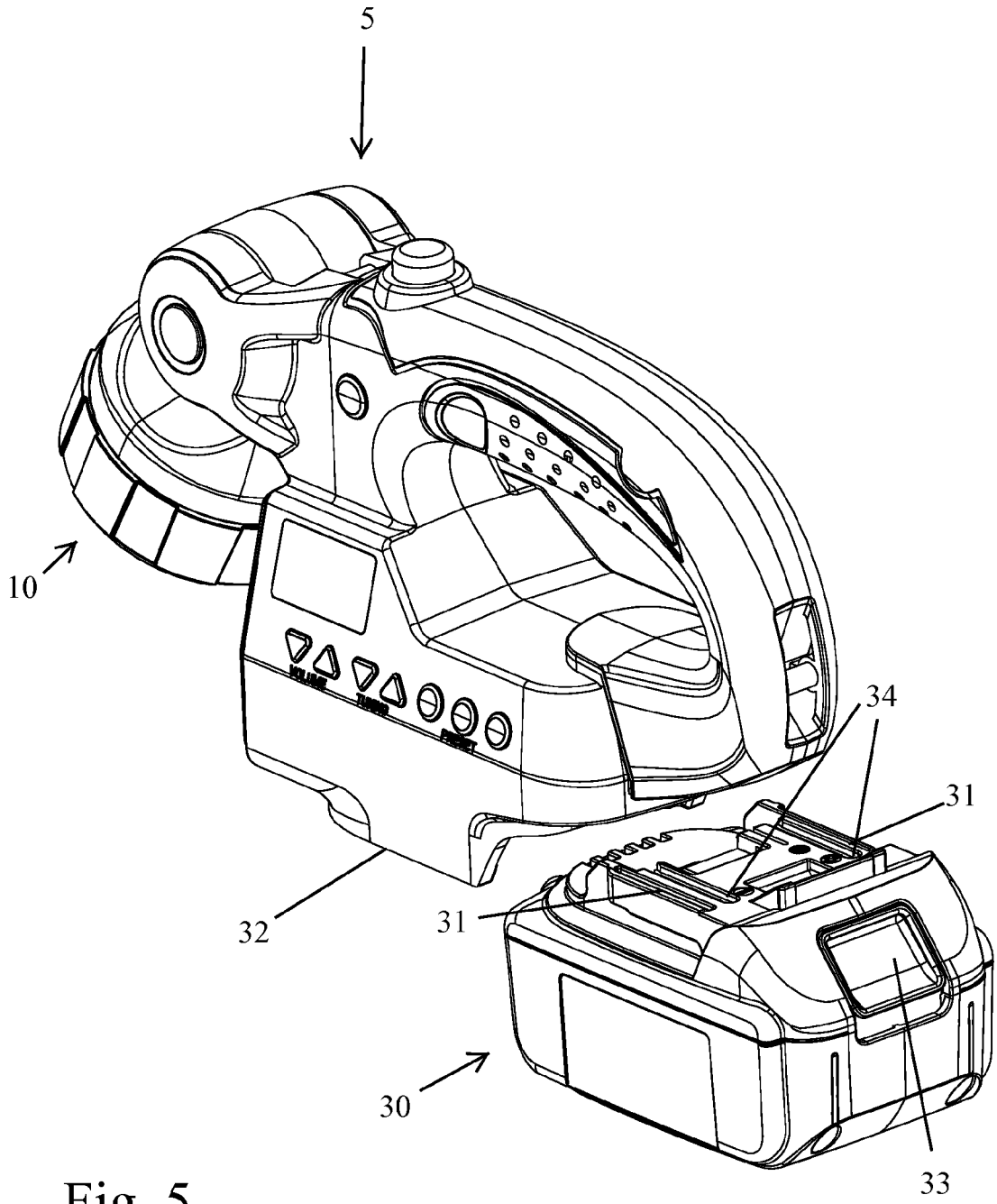
FIG. 5 shows a perspective rear view of the device according to FIGS. 1-4 with the rechargeable battery pack in a detached state.
Figure 6:
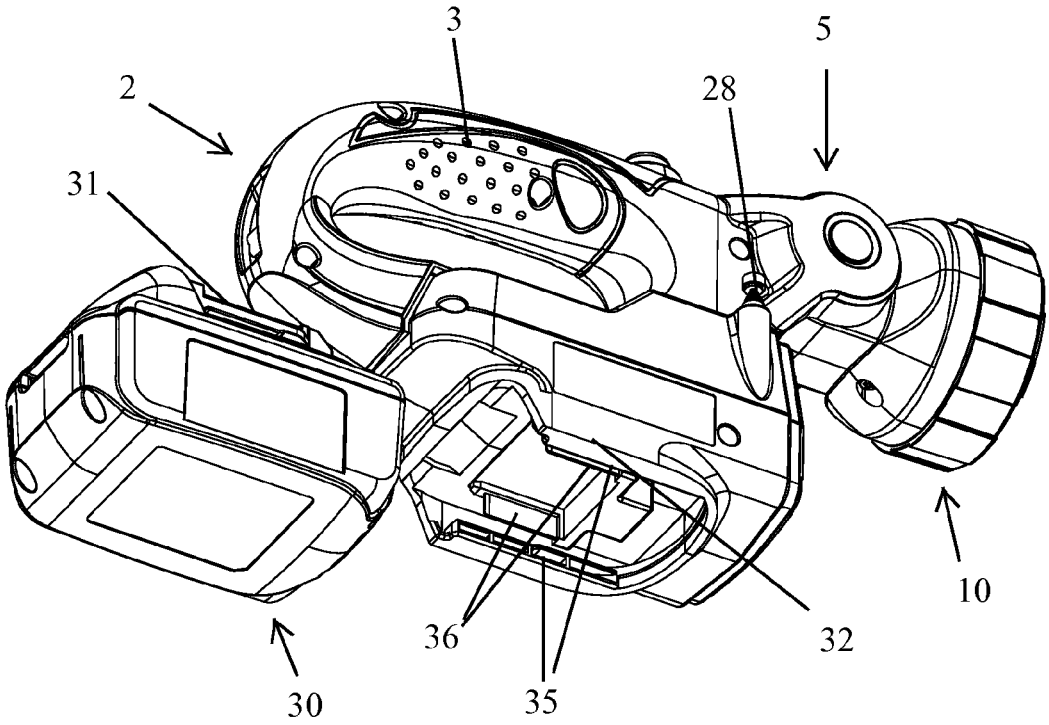
FIG. 6 shows perspective lower, rear view of device according to FIGS. 1-5 with the rechargeable battery pack in a detached state.

Referring now to FIGS. 4 to 6, a rechargeable battery pack 30 is detachably attached to a battery pack holder 32 disposed or defined on the lower or bottom portion of the housing 2. As shown in FIG. 6, the battery pack holder 32 preferably includes two or more rails 35 for slidably receiving/engaging the battery pack 30 and two or more electrical contacts 36 for receiving power from the battery pack 30 and supplying the power to the internal circuitry of the device 1.

The battery pack 30 provides power for operating the lamp unit 10 and the radio unit 20, as well as any control circuitry contained within the housing 2, as will be further discussed below. Although a sliding-type battery pack 30 is preferred, an insertion-type battery pack (i.e. a portion of the battery pack is inserted into the housing 2) is also included within the scope of the present teachings.

The battery pack 30 preferably includes two or more rails 31 configured to slidably engage the corresponding rails 35 disposed on the battery pack holder 32 of the housing 2. Two or more electrical contacts 34 are preferably provided on the battery pack 30, including e.g., positive and negative battery terminals as well as an optional controller communication port or terminal, which may be configured to permit communication between a microprocessor disposed in the battery pack 30 and one or more microprocessors disposed in the housing 2.

A latch 33 may be depressed by the operator to release and remove the battery pack 30 from a locked engagement with the battery holder portion 32 of the housing 2. The battery pack 30 is preferably configured to output a voltage between 10 to 36 volts, more preferably between 10 to 24 volts, even more preferably between 14 to 18 volts. Further, the battery pack 30 is preferably configured to supply sufficient current to drive/operate the lamp(s) 11 and the radio unit 20. As representative, non-limiting examples, the radio unit 20 of a representative device 1 according to the present teachings may be expected to draw about 50-500 mA, more preferably about 100-200 mA, and the lamp(s) 11 may be expected to draw between about 0.5-3.0 A, more preferably about 0.5-1.0 A.

A variety of rechargeable battery pack designs may be utilized with the present teachings and representative examples are taught in US patent publication nos. 2010-0156350, 2010-0129701, 2010-0085020, 2010-0085010, 2010-0085008, 2010-0084150, 2010-0063757, 2005-0112416, 2002-0079867, all of which are incorporated herein by reference. Furthermore, a variety of battery chemistries may be utilized with the present teachings, including but not limited to, lithium ion (Li-ion), lithium ion polymer (Li-ion polymer), nickel metal hydride (NiMH) and nickel cadmium (NiCd).

The device 1 is preferably configured to operate with a variety of different battery packs 30 configured to supply a voltage within the above-noted ranges. For example, the device 1 is preferably configured to operate with any type of battery pack 30, as described above, that outputs a voltage between, e.g., 9.6 to 36 volts, more preferably between 10 to 24 volts, and even more preferably between 14-18 volts. Appropriate voltage detection and conversion circuitry may be provided in the housing 2 to convert the outputted battery voltage to the internal voltage(s) required to operate the lamp unit 10 and the radio unit 20, as well as any control circuitry.

Figure 7:
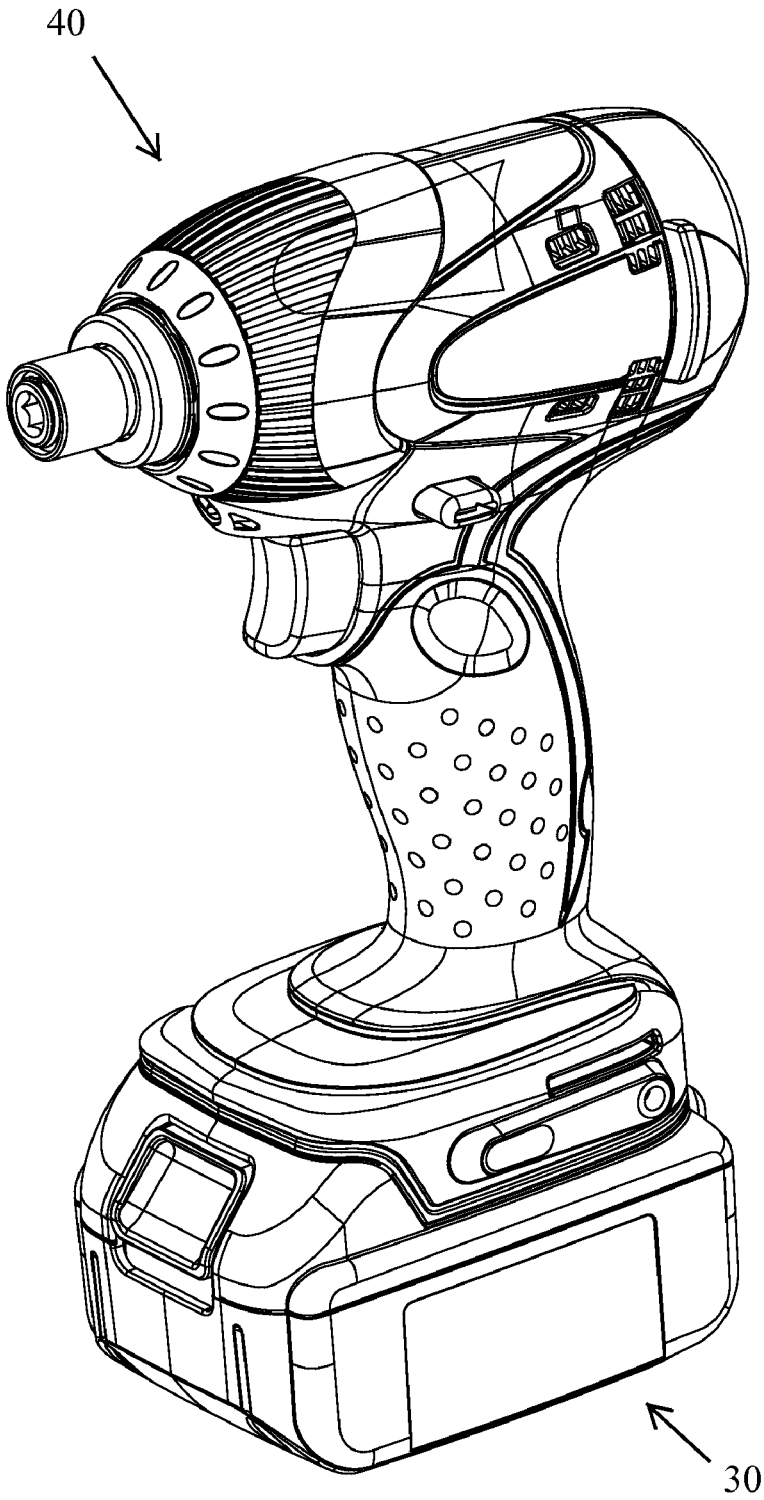
FIG. 7 shows a power tool with an attached rechargeable battery pack according to the present teachings.

As shown in FIG. 7, the rechargeable battery pack 30 is preferably also configured to drive a power tool, such as an power screwdriver or impact driver 40 having, e.g., a handle, housing, trigger switch, internal motor and tool bit.

Figure 8:
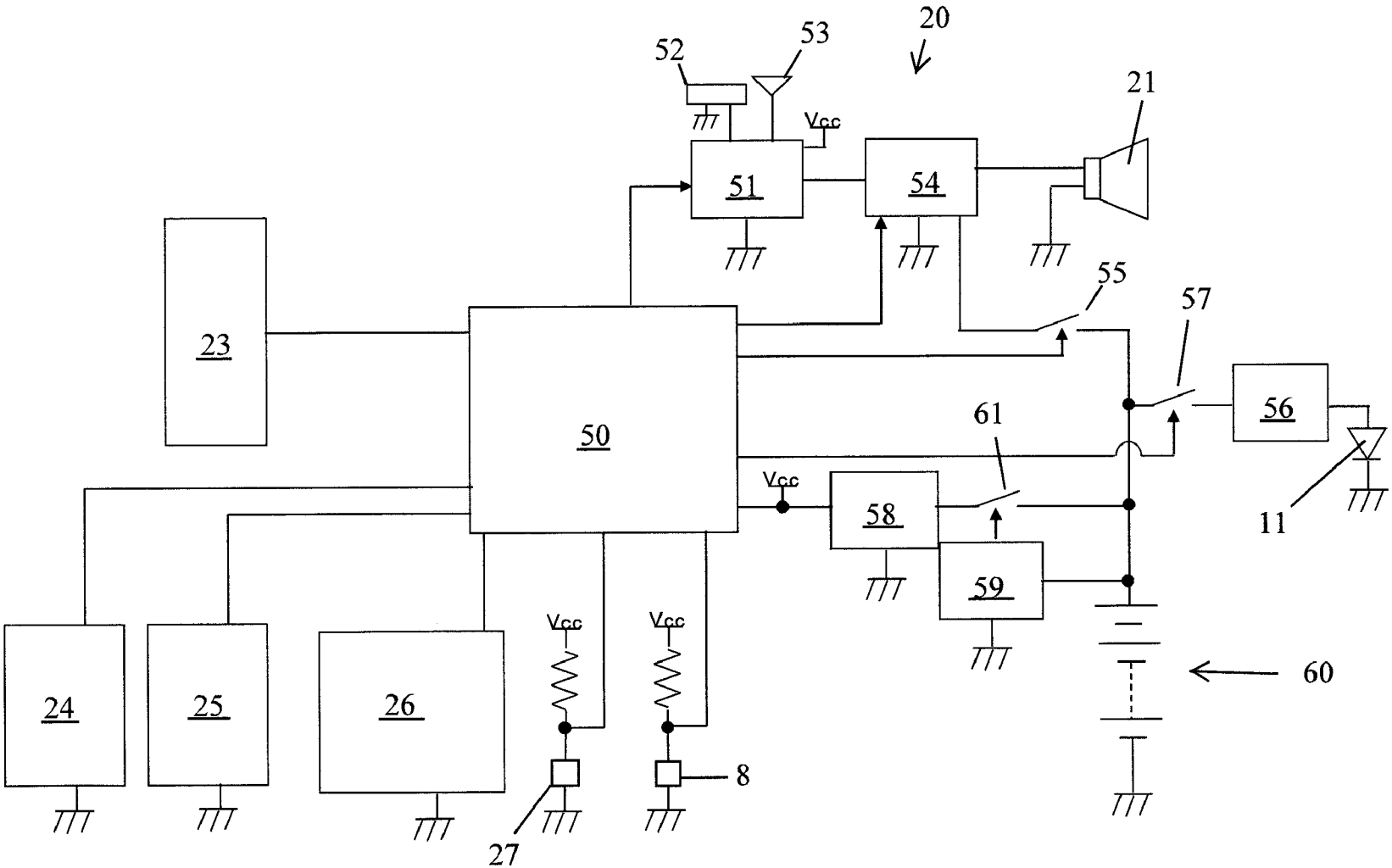
FIG. 8 shows a representative circuit diagram for the device of FIGS. 1-6.

FIG. 8 shows a representative, non-limiting circuit configured to perform the radio and flashlight functions. For example, a central processing unit (CPU) 50, e.g., one or more microprocessors preferably with accompanying memory and/or storage, may be configured to receive or input control signals from the above-described tuning button(s) 24, volume control button(s) 25, preset station button(s) 26, radio power switch 27 and flashlight switch 8. The CPU 50 is also configured or programmed to cause status information, as was described above, to be shown on the display 23.

A tuner 51 processes signals received from the AM antenna 52 and/or the FM antenna 53 and outputs an audio signal to an amplifier 54, which is electrically coupled to the above-described speaker 21. The CPU 50 also may control a power switch 55 that electrically couples current from one or more battery cells 60 to the radio circuitry 20 when the radio power button 27 is actuated.

The CPU 50 is also configured or programmed to control the illumination of the lamp(s) 11, preferably one or more LEDs, when the flashlight switch 8 is actuated, e.g., by closing a power switch 57, thereby enabling current to be supplied to an LED driver circuit 56.

Finally, a voltage regulator 58 is preferably provided to regulate the voltage output by the battery cell(s) 60 and thus provide the requisite internal voltage(s) necessary to operate the various circuit elements. As was noted above, the voltage regular 58 is preferably configured to operate based upon a wide range of battery voltages that could be supplied by the different types of battery packs 32 that may be attached to the device 1. A low battery voltage circuit 59 is preferably configured to open a switch 61 when a low battery state is detected in order to prevent an excessive or over-discharge of the battery cell(s) 60.

Referring once again to FIG. 2, the speaker 21 is preferably mounted on the forward or front side of the housing 2. Thus, the speaker 21 is oriented in the same direction as the lamp unit 10. By disposing the speaker 21 and the lamp unit 10 so they are both oriented in the same direction, a power savings and improved performance can be achieved. Typically, such a device 1 will be utilized by placing it at a location where the lamp(s) 11 can adequately illuminate an intended work area. The lamp unit 10 may also be appropriately pivoted about hinge 5 to provide optimal lighting of the work area with the device 1 disposed or set at a convenient location. The operator then stands in or near the work area illuminated by the lamp(s) 11. Since the speaker 21 is also directed in the same direction, the sound from the speaker 21 is focused on the same work area as the illumination. Consequently, as compared to a flashlight/radio device, in which the speaker is oriented in a direction away from the work area, such as the above-described flashlight/radio previously sold by Hitachi Koki Co., Ltd., the volume can be set at a lower level while achieving the same level of sound (dB) in the work area.

In addition to a lower power consumption, because the operator will hear the sound coming on a direct path from the speaker 21, rather than being reflected (in case the speaker does not directly face the work area and thus the illumination area), an improved sound clarity or fidelity in the work area can also be achieved.

In a further preferred aspect of the present teachings, the lamp unit 10 preferably has approximately the same width W as the widest portion of the front side of the housing 2 and/or the front side of the battery pack 30, as indicated in FIG. 2. The lamp unit 10 may be slightly wider or slightly narrower than the front side of the housing 2. The protective grill 22 for the speaker 21 may also have substantially the same width W as the front side of the housing 2, or may be narrower. The size of the speaker 21 may be slightly less than the width of the front side of the housing 2 so as to maximize the output of the speaker 21 relative to the overall size of the device 1.

The width W of the device 1 is preferably between 6-12 centimeters, more preferably between 7-10 centimeters.

Figure 3:
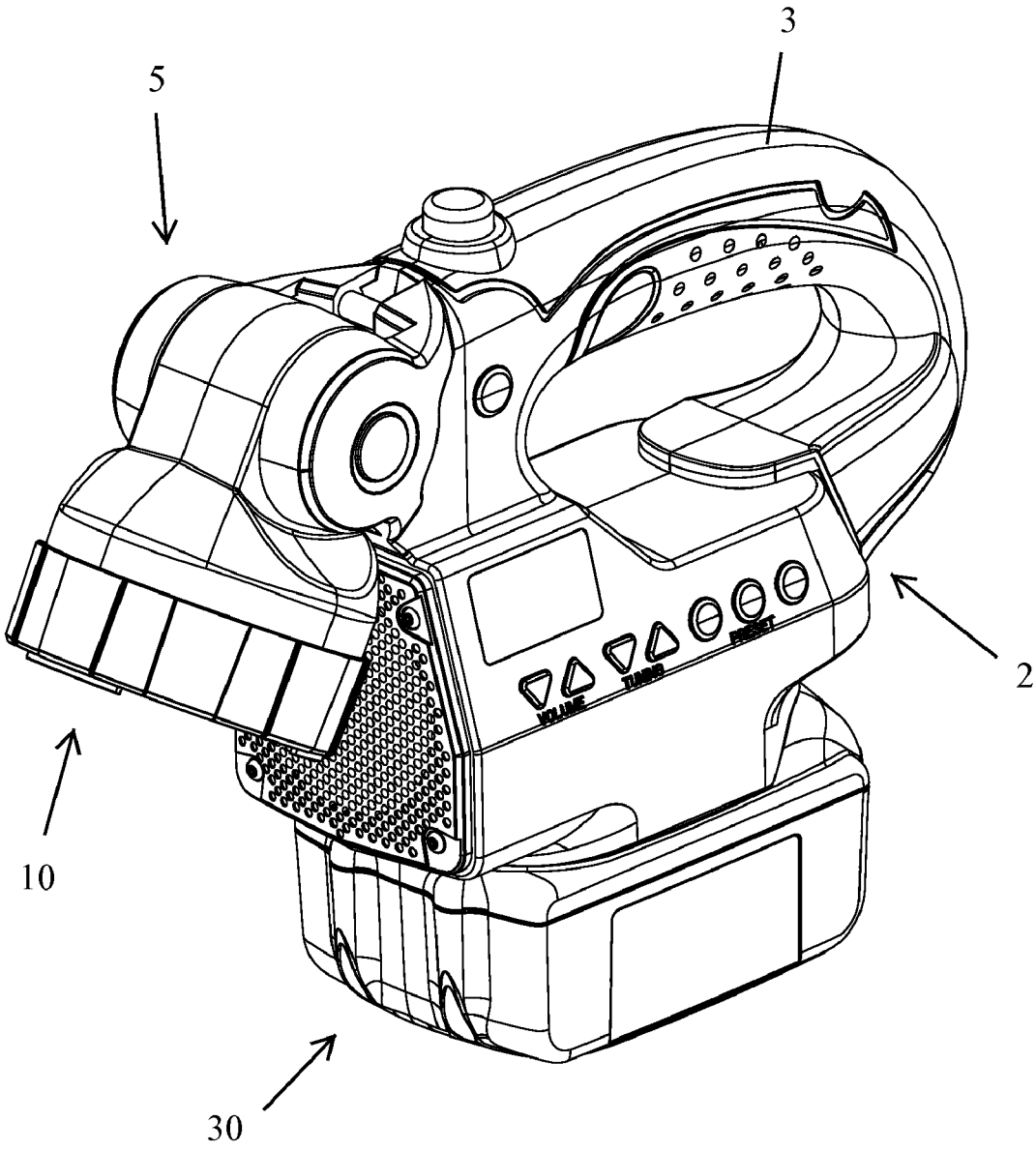
FIG. 3 also shows a front perspective view of the device according to FIG. 1, but with the lamp unit pivoted downwardly.

In a further preferred aspect of the present teachings, the lamp unit 10 is preferably pivotable downward so as to at least partially cover and/or protect the speaker 21 and the protective grill 22 during transport, as shown e.g., in FIG. 3. The hinge 5 may include a stop that prevents the lamp unit 10 from ever contacting the protective grill 22, thereby preventing damage to the protective grill 22 and the speaker 21 by a lamp unit 10 that has been pivoted downwardly too far.

In a further preferred aspect, the device 1 is preferably configured to be compatible with MP3/iPod® devices or other external audio storage devices. For example, a plug port or socket may be provided on the housing 2 to input data from an external MP3 player or other auxiliary device and the signals may be appropriately processed by the internal circuitry, so that the speaker 21 outputs sound corresponding to the data stored on the external device. The display 23 optionally may be configured to indicate the artist and/or song title currently being played. An optional holder for the external audio storage device may be provided or mounted on the housing 2 for convenient transport and/or protection of the external audio storage device.

A headphone socket may also optionally be provided on the housing 3 and electrically coupled to the amplifier 54.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved flashlight/radio devices and methods for manufacturing and using the same.

Moreover, combinations of features and steps disclosed in the above detail description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

| | |
|---|---|
| 1 | combination flashlight/radio device |
| 2 | housing |
| 3 | handle |
| 4 | hollow space |
| 5 | hinge |
| 6 | abutment portion |
| 7 | strap holders |
| 8 | power switch for flashlight |
| 9 | soft grip portion |
| 10 | lamp unit |
| 11 | lamps |
| 12 | reflectors |
| 13 | reflector retainer |
| 14 | lamp case |
| 20 | radio unit |
| 21 | speaker |
| 22 | protective grill |
| 23 | display |
| 24 | volume buttons |
| 25 | tuning buttons |
| 26 | preset station buttons |
| 27 | power switch for radio |
| 28 | screws |
| 30 | rechargeable battery pack |
| 31 | rails on battery pack |
| 32 | battery holder portion on housing |
| 33 | latch |
| 34 | contact terminals on battery |
| 35 | rails on battery holder portion |
| 36 | contact terminals on battery holder portion |
| 40 | power tool |
| 50 | CPU |
| 51 | tuner |
| 52 | AM antenna |
| 53 | FM antenna |
| 54 | amplifier |
| 55 | switch |
| 56 | LED driver circuit |
| 57 | switch |
| 58 | voltage regulator |
| 59 | battery low voltage detector |
| 60 | battery cells |
| 61 | switch |

The invention claimed is:

1. A portable battery-powered device comprising:

a housing, a lamp unit pivotably attached to a front side of the housing, a radio unit disposed within the housing, at least one speaker electrically coupled to the radio unit and disposed on the front side of the housing such that the lamp unit and the speaker face the same direction, and a battery pack holder disposed on a bottom side of the housing and configured to detachably retain a rechargeable battery pack.

2. The portable battery-powered device according to claim 1, further comprising a rechargeable battery pack mounted on and electrically coupled to the battery pack holder.

3. The portable battery-powered device according to claim 2, wherein the rechargeable battery pack is configured to slidably engage the battery pack holder.

4. The portable battery-powered device according to claim 2, wherein the battery pack is configured to output a voltage between 10-36 volts and the device is configured to operate based upon any inputted voltage between 10-36 volts.

5. The portable battery-powered device according to claim 1, wherein the lamp unit has substantially the same width as a widest portion of the front side of the housing.

6. The portable battery-powered device according to claim 1, wherein the speaker is disposed on the housing directly between the lamp unit and the battery pack holder.

7. The portable battery-powered device according to claim 6, further comprising a protective grill covering the speaker, wherein a widest portion of the protective grill has substantially the same width as the lamp unit.

8. The portable battery-powered device according to claim 7, wherein the speaker has substantially the same width as the lamp unit.

9. The portable battery-powered device according to claim 7, wherein the lamp unit is configured to cover and protect at least a portion of the protective grill when the lamp unit is pivoted towards the bottom side of the housing.

10. The portable battery-powered device according to claim 1, further comprising a handle coupled to an upper side of the housing, wherein a hollow space is defined between the handle and the housing.

11. The portable battery-powered device according to claim 1, further comprising a lamp unit switch disposed on the upper side of the handle.

12. The portable battery-powered device according to claim 1, further comprising a display and one or more switches configured to control the radio unit disposed on a lateral side of the housing.

13. The portable battery-powered device according to claim 1, wherein the lamp unit has an illumination output between 500 to 5,000 lux.

14. The portable battery-powered device according to claim 1, wherein the front side of the housing has a width between 6-12 centimeters.

15. A portable battery-powered device comprising:

a housing, a lamp unit pivotably attached to a front side of the housing, radio circuitry disposed within the housing, a battery pack holder defined on a lower side of the housing, at least one speaker electrically coupled to the radio circuitry and disposed on the front side of the housing directly between the lamp unit and the battery pack holder such that both illumination from the lamp unit and sound from the at least one speaker project from the device in a forward direction of the device, a protective grill covering the speaker, wherein a widest portion of the protective grill, a widest portion of the lamp unit and a widest portion of the front side of the housing have substantially the same width, and a rechargeable battery pack slidably and detachably engaged with the battery pack holder, the battery pack being configured to output a voltage between 10-36 volts and the device being configured to operate based upon any inputted voltage between 10-36 volts.

16. The portable battery-powered device according to claim 15, wherein the lamp unit is configured to cover and protect at least a portion of the protective grill when the lamp unit is pivoted towards the bottom side of the housing.

17. The portable battery-powered device according to claim 16, further comprising:

a handle coupled to an upper side of the housing, wherein a hollow space is defined between the handle and the housing, a lamp unit switch disposed on an upper side of the handle, a radio power switch disposed on a lateral side of one of the housing and the handle, and a display disposed on the lateral side of the housing and configured to display status information, wherein the lamp unit switch and the radio power switch are disposed so as to be both actuatable with a thumb of a hand gripping the handle.

18. The portable battery-powered device according to claim 17, wherein the lamp unit has an illumination output between 500 to 5,000 lux and the front side of the housing has a width between 6-12 centimeters.

19. The portable battery-powered device according to claim 18, wherein the lamp unit has an illumination output between 1,200 to 3,500 lux, the front side of the housing has a width between 7-10 centimeters and the battery pack is configured to output a voltage between 14-18 volts.

20. The portable battery-powered device according to claim 19, further comprising a microprocessor configured to:

control the radio circuitry and the lamp unit based upon signals input from the lamp unit switch and at least one operator-actuated switch configured to control the radio circuitry and communicate the status information to the display; and wherein the rechargeable battery pack is configured to detachably attach to a battery-operated power tool.

* * * * *